US009365036B2

(12) United States Patent
Hirayama

(10) Patent No.: US 9,365,036 B2
(45) Date of Patent: Jun. 14, 2016

(54) PRINTING APPARATUS AND PRINTHEAD

(71) Applicant: CANON KABUSHIKI KAISHA, Tokyo (JP)

(72) Inventor: Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/613,706

(22) Filed: Feb. 4, 2015

(65) Prior Publication Data

US 2015/0246534 A1 Sep. 3, 2015

(30) Foreign Application Priority Data

Feb. 28, 2014 (JP) ..... 2014-039288

(51) Int. Cl.
*B41J 2/14* (2006.01)
*B41J 2/045* (2006.01)

(52) U.S. Cl.
CPC ..... *B41J 2/14072* (2013.01); *B41J 2/0458* (2013.01); *B41J 2/04543* (2013.01); *B41J 2/04548* (2013.01); *B41J 2/14112* (2013.01); *B41J 2202/20* (2013.01)

(58) Field of Classification Search
CPC ..... B41J 2/14072; B41J 2/14112
See application file for complete search history.

(56) References Cited

U.S. PATENT DOCUMENTS

| | | | | |
|---|---|---|---|---|
| 7,531,996 | B2 | 5/2009 | Yang et al. | |
| 7,538,529 | B2 | 5/2009 | Nishida | |
| 2008/0150359 | A1* | 6/2008 | Yamada | 307/28 |
| 2010/0117611 | A1 | 5/2010 | Yamada | |
| 2012/0194587 | A1* | 8/2012 | Teshigawara et al. | 347/12 |
| 2013/0038314 | A1* | 2/2013 | Nakashima | 323/304 |

FOREIGN PATENT DOCUMENTS

| | | | |
|---|---|---|---|
| CN | 1922785 | A | 2/2007 |
| JP | 2007-296638 | A | 11/2007 |
| JP | 2010-115072 | A | 5/2010 |

OTHER PUBLICATIONS

Office Action issued in Chinese Patent Application No. 201510087372.7, dated Feb. 25, 2016.

* cited by examiner

*Primary Examiner* — Kristal Feggins
*Assistant Examiner* — Kendrick Liu
(74) *Attorney, Agent, or Firm* — Fitzpatrick, Cella, Harper & Scinto

(57) ABSTRACT

A printing apparatus includes N (N is an integer equal to or larger than two) printing element substrates each including a printing element, wherein each of the N printing element substrates includes a first terminal serving as a terminal on a high-potential side to receive a power supply voltage to be supplied to the printing element and a second terminal serving as a terminal on a low-potential side to receive the power supply voltage, and a first wiring connects the first terminal of a kth (k is an integer of one (inclusive) to N−1 (inclusive)) printing element substrate and the second terminal of a (k+1) th printing element substrate with each other, and is connected to one end of a second wiring to which a power supply voltage is supplied.

10 Claims, 12 Drawing Sheets

(FIRST EMBODIMENT)

PRINTING APPARATUS AND PRINTHEAD

BACKGROUND OF THE INVENTION

1. Field of the Invention

The present invention relates to a printing apparatus and a printhead.

2. Description of the Related Art

Japanese Patent Laid-Open No. 2007-296638 exemplifies a printhead including a plurality of printing element substrates. The plurality of printing element substrates are arranged in two columns in a staggered arrangement, and form a so-called full-line type printhead capable of printing, at once, an entire region in the widthwise direction of a printing medium (a direction intersecting the conveyance direction of the printing medium). The printhead includes a power supply wiring for supplying a power supply voltage to each of the plurality of printing element substrates. In general, a flexible cable is used as the power supply wiring.

If the number of printing elements driven on the respective printing element substrates increases, a voltage drop may occur in the above-described power supply wiring. On the other hand, if the plurality of power supply wirings corresponding to the plurality of printing element substrates are provided to be able to supply the power supply voltages to the plurality of printing element substrates individually, at least two power supply terminals, a positive terminal and a negative terminal, for receiving the power supply voltages need to be provided for each printing element substrate. That is, for example, if the number of printing element substrates is N, 2×N power supply wirings are provided.

SUMMARY OF THE INVENTION

The present invention provides a technique advantageous in reducing the number of power supply wirings while suppressing a voltage drop in the power supply wirings in a printhead including a plurality of printing element substrates.

One of the aspects of the present invention provides a printing apparatus, comprising N (N is an integer equal to or larger than two) printing element substrates each including a printing element, wherein each of the N printing element substrates includes a first terminal serving as a terminal on a high-potential side to receive a power supply voltage to be supplied to the printing element and a second terminal serving as a terminal on a low-potential side to receive the power supply voltage, and a first wiring connects the first terminal of a kth (k is an integer of one (inclusive) to N−1 (inclusive)) printing element substrate and the second terminal of a (k+1) th printing element substrate with each other, and is connected to one end of a second wiring to which a power supply voltage is supplied.

Further features of the present invention will become apparent from the following description of exemplary embodiments with reference to the attached drawings.

DESCRIPTION OF THE EMBODIMENTS

First Embodiment

Figure 1:
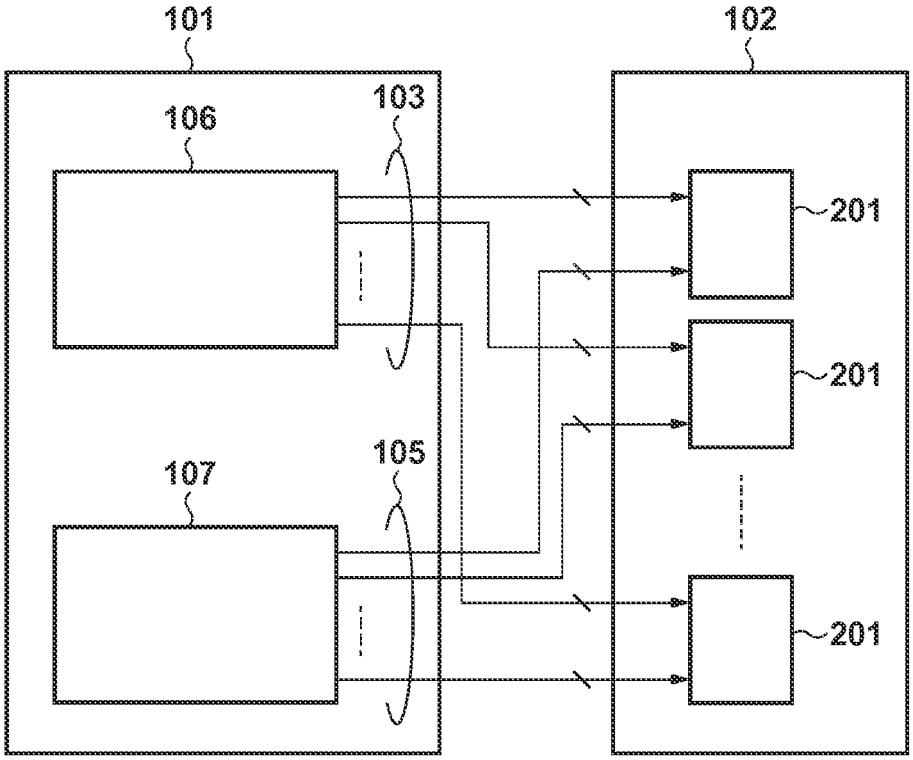
FIG. 1 is a view for explaining the outline of an example of the arrangement of a printing apparatus.

The first embodiment will be described with reference to FIGS. 1 to 5. FIG. 1 is a block diagram for explaining an example of the arrangement of a printing apparatus PA. The printing apparatus PA is mainly divided into a main body 101 and a printhead 102. The printhead 102 includes a plurality of printing element substrates 201. A plurality of printing elements are arranged in each printing element substrate 201. The main body 101 includes, for example, a voltage supply unit 106 and a control unit 107. The voltage supply unit 106 supplies a power supply voltage to each of the plurality of printing element substrates 201 via a power supply line 103. The control unit 107 supplies a control signal to each of the plurality of printing element substrates 201 via a driving signal line 105.

Figure 2:
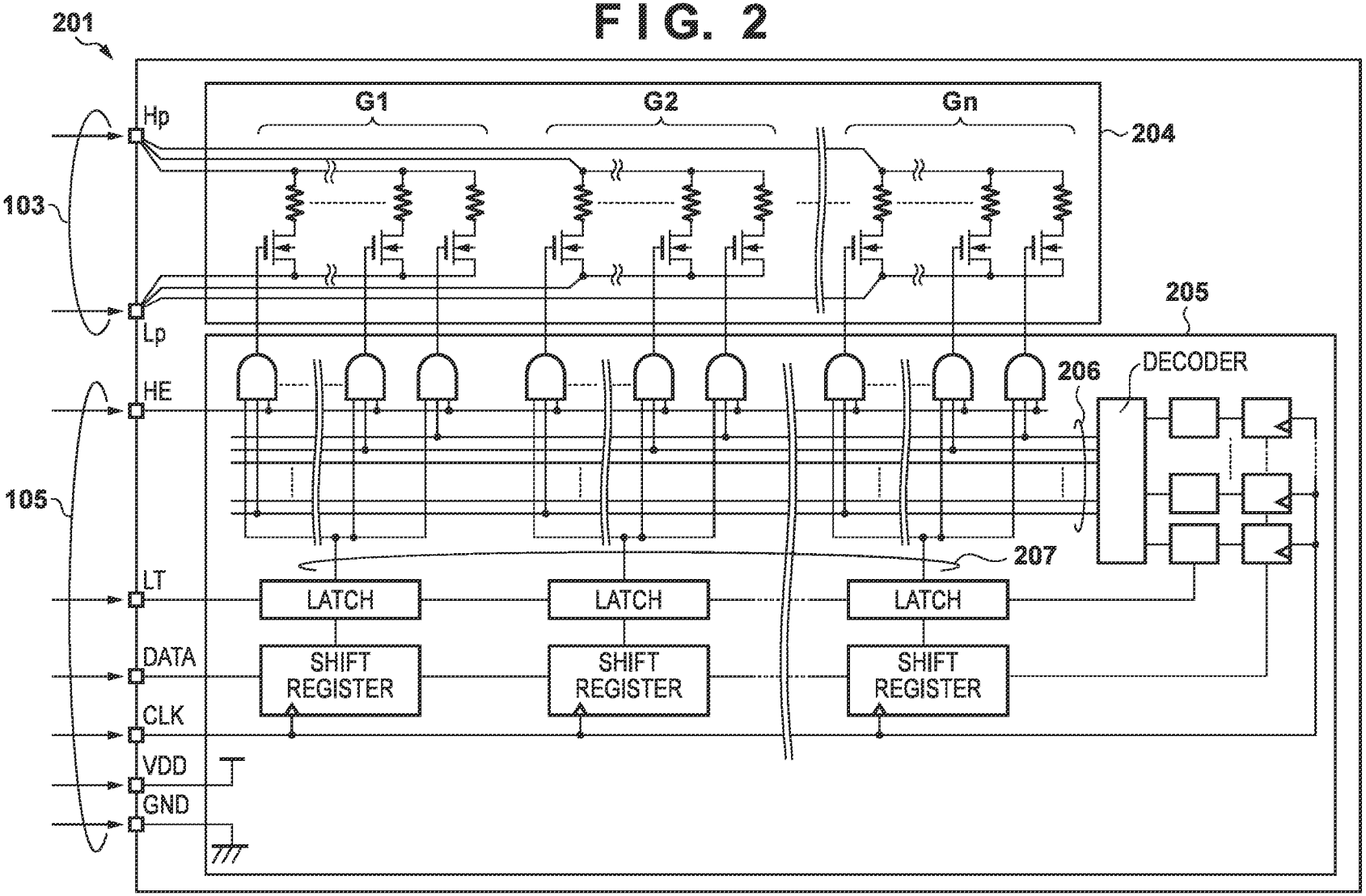
FIG. 2 is a view for explaining an example of the arrangement of a printing element substrate.

FIG. 2 shows an example of the arrangement of the printing element substrate 201. In this embodiment, the printing element substrate 201 includes a driving unit 204 (to be referred to as a "driving unit 204" hereinafter) and a printing element selecting unit 205 (to be referred to as a "selecting unit 205" hereinafter).

The driving unit 204 includes the plurality of printing elements and a plurality of driving elements. Each driving element is arranged to correspond to one printing element, and changes to a conductive state to drive the corresponding printing element. Note that each printing element uses a resistance element as a heater which is energized to generate heat, and is formed by a thin metal film of TaSiN or the like. On the other hand, each driving element uses a transistor such as a MOS transistor. These printing elements and the driving elements are divided into a plurality of groups G, that is, G1 to Gn. Each printing element is driven by a so-called time-divisional driving method. More specifically, the driving unit 204 drives the plurality of printing elements upon receiving a block signal 206 that determines printing elements in each group which are to be selected and a data signal 207 for driving the selected printing elements.

The selecting unit 205 can include a plurality of shift registers, a plurality of latches, a decoder, and AND circuits. Each shift register transfers data held by the shift register to the shift register of a next stage upon receiving a clock signal (CLK). Each latch latches data held by the corresponding shift register upon receiving a latch signal (LT). The decoder outputs the block signal 206 upon receiving an output from each latch.

Each AND circuit outputs a signal to the control terminal of the corresponding driving element (the gate of the MOS transistor) upon receiving a heat enable signal (HE), the block signal 206, and the data signal 207 from the corresponding latch. The printing element that should be selected by the block signal 206 and driven by the data signal 207 is driven over a period corresponding to the pulse width of HE, and generates heat energy by an amount corresponding to the period. The printhead 102 includes nozzles (orifices) corresponding to the printing elements. A printing agent (ink) supplied from a printing agent supply unit foams upon receiving this heat energy, and is discharged from the nozzles.

A heater voltage (for example, 32V) is supplied to the driving unit 204. FIG. 2 illustrates a terminal Hp for receiving the heater voltage as a power supply terminal and a terminal Lp as a ground terminal corresponding to the heater voltage. The plurality of printing elements and the corresponding plurality of driving elements are connected in series. Each printing element and each driving element are connected in parallel between a power supply node electrically connected to the terminal Hp and a ground node electrically connected to the terminal Lp.

Respective circuit units receiving the plurality of voltages described above are electrically separated or insulated from each other. The voltage is applied to operate each circuit unit appropriately. Also, printing element substrates $\mathbf{201}_1$ and $\mathbf{201}_2$ need to be electrically separated or insulated from each other. Each element such as the MOS transistor may be formed by using, for example, a triple well structure or an SOI substrate.

Figure 3A:
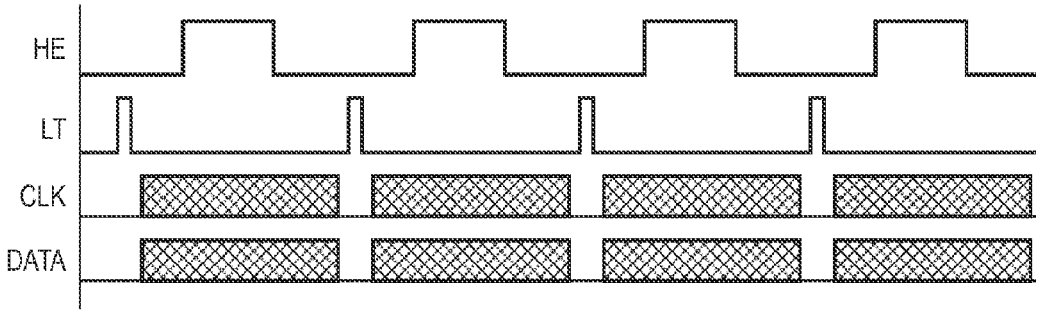
FIGS. 3A and 3B are timing charts for explaining the operation.
Figure 3B:
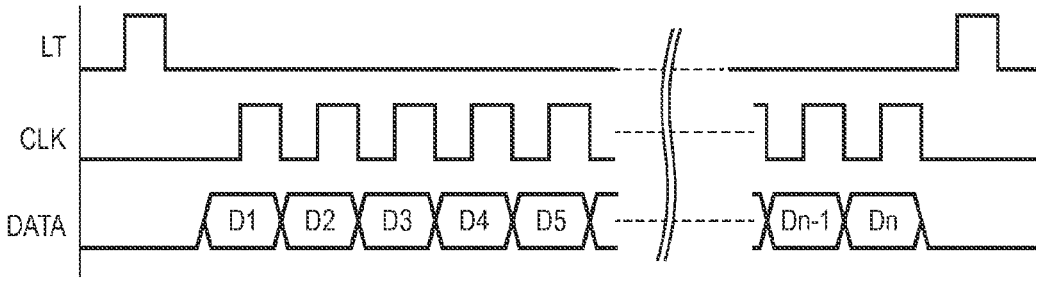

FIGS. 3A and 3B show the operation timing charts of the printing apparatus PA for each of the signals (HE, LT, CLK, and DATA) input to the printing element substrates 201 via the driving signal line 105. Letting a period between respective pulses of the latch signals (LT signals) be one cycle, FIG. 3A shows the timing chart of four cycles. In FIG. 3A, a heater signal is input once in one cycle at a predetermined timing. Each transistor serving as the driving element is turned on/off by this heater signal (HE signal), thereby turning on/off the heater. FIG. 3B is an enlarged timing chart of LT, CLK, and DATA for one cycle.

The DATA signals are data signals corresponding to the plurality of heater groups G1 to Gn, respectively, in the driving unit 204. FIG. 3B illustrates a case in which there are n heater groups. The DATA signals of the respective heater groups in the driving unit 204 are input in one cycle. The clock signal (CLK signal) and the DATA signal are synchronized with each other. When the DATA signal is input (becomes High out of High and Low in this embodiment), the heater group to be High is selected. More specifically, information on the DATA signal is transferred to and written in the shift register of the selecting unit 205 corresponding to the heater group each time the clock signal is input. Then, when the LT signal is input, the information on the DATA signals is written in each latch. A heater which is turned on within the heater group is selected by the block signal shown in FIG. 2. Then, the HE signal is input based on the information written in each shift register. This drives a predetermined heater out of the plurality of heaters in the driving unit 204. That is, the HE signal of the next cycle turns on/off each transistor of the driving unit 204 based on information specified in a certain cycle.

Figure 4:
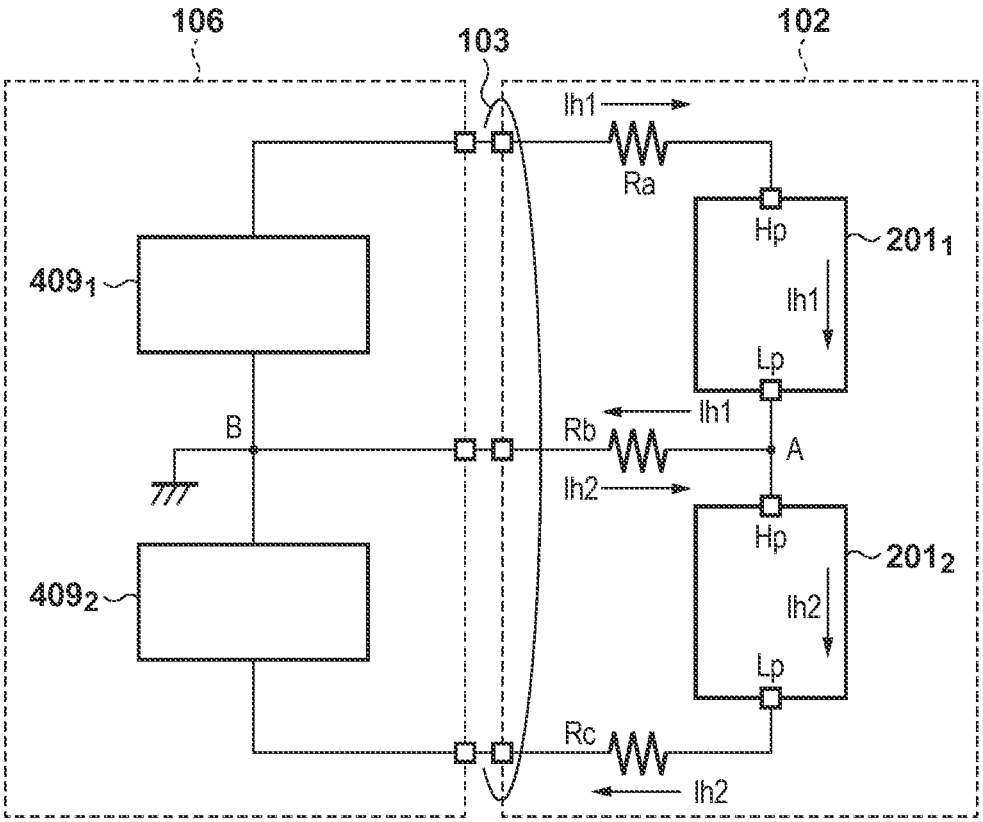
FIG. 4 is a view for explaining an example of the arrangement for supplying a power supply voltage to a printhead.

FIG. 4 mainly shows, out of the example of the arrangement of the printing apparatus PA according to this embodiment, the portions of the voltage supply unit 106 and the printhead 102. Here, the printhead 102 includes two printing element substrates 201, that is, the first printing element substrate $\mathbf{201}_1$ and the second printing element substrate $\mathbf{201}_2$. The voltage supply unit 106 includes a first voltage source $\mathbf{409}_1$ for supplying the power supply voltage to the printing element substrate $\mathbf{201}_1$ and a second voltage source $\mathbf{409}_2$ for supplying the power supply voltage to the printing element substrate $\mathbf{201}_2$.

The first wiring electrically connects the terminal Lp of the printing element substrate $\mathbf{201}_1$ and the terminal Hp of the printing element substrate $\mathbf{201}_2$ with each other. One power supply wiring (second wiring) is connected to the terminal Lp of the printing element substrate $\mathbf{201}_1$ and the terminal Hp of the printing element substrate $\mathbf{201}_2$. Also, the third wiring electrically connects the terminal of the voltage source $\mathbf{409}_1$ on a low-potential side and the terminal of the voltage source $\mathbf{409}_2$ on a high-potential side with each other. The printing element substrate $\mathbf{201}_1$ and the printing element substrate $\mathbf{201}_2$ are connected in series.

The voltage source $\mathbf{409}_1$ is connected between the terminal Hp and the terminal Lp of the printing element substrate $\mathbf{201}_1$. More specifically, the terminal of the voltage source $\mathbf{409}_1$ on the high-potential side is connected to the terminal Hp of the printing element substrate $\mathbf{201}_1$ and the terminal of the voltage source $\mathbf{409}_1$ on the low-potential side is connected to the terminal Lp of the printing element substrate $\mathbf{201}_1$. Similarly, the voltage source $\mathbf{409}_2$ is connected between the terminal Hp and the terminal Lp of the printing element substrate $\mathbf{201}_2$. Furthermore, the terminal Lp of the printing element substrate $\mathbf{201}_1$ and the terminal Hp of the printing element substrate $\mathbf{201}_2$ (node A between them) are electrically connected to node B between the voltage sources $\mathbf{409}_1$ and $\mathbf{409}_2$.

A resistance Ra exists in a path between the terminal Hp of the printing element substrate $\mathbf{201}_1$ and the voltage source $\mathbf{409}_1$. The resistance Ra is the resistance component of the power supply wiring in the path. A resistance Rb exists in a path between Node A between the terminal Lp of the printing element substrate $\mathbf{201}_1$ and the terminal Hp of the printing element substrate $\mathbf{201}_2$, and node B between the voltage sources $\mathbf{409}_1$ and $\mathbf{409}_2$. The resistance Rb is the resistance component of the power supply wiring in the path. A resistance Rc exists in a path between the terminal Lp of the printing element substrate $\mathbf{201}_2$ and the voltage source $\mathbf{409}_2$. The resistance Rc is the resistance component of the power supply wiring in the path. Note that node B is grounded here.

A current Ih1 indicates a current flowing through the printing element substrate $\mathbf{201}_1$ when printing is performed by the printing element array of the printing element substrate $\mathbf{201}_1$. A current Ih2 indicates a current flowing through the printing element substrate $\mathbf{201}_2$ when printing is performed by the printing element array of the printing element substrate $\mathbf{201}_2$. In this case, a voltage drop in the resistance Ra can be represented by Ra×Ih1, and a voltage drop in the resistance Rc can be represented by Rc×Ih2. On the other hand, a voltage drop in the resistance Rb can be represented by Rb×(Ih−Ih2). That is, as illustrated in FIG. 4, in an arrangement where node B is grounded, the potential of node A becomes higher than 0 [V] when Ih1>Ih2, and becomes lower than 0 [V] when Ih1<Ih2. Also, when Ih1=Ih2, the potential of node A becomes 0 [V]. Note that node B is grounded in this arrangement. However, the present invention is not limited to this arrangement. For example, when node B is fixed to another reference potential, the potential of node A becomes higher or lower than the reference potential depending on the magnitude relationship between the above-described Ih1 and Ih2.

Figure 5:
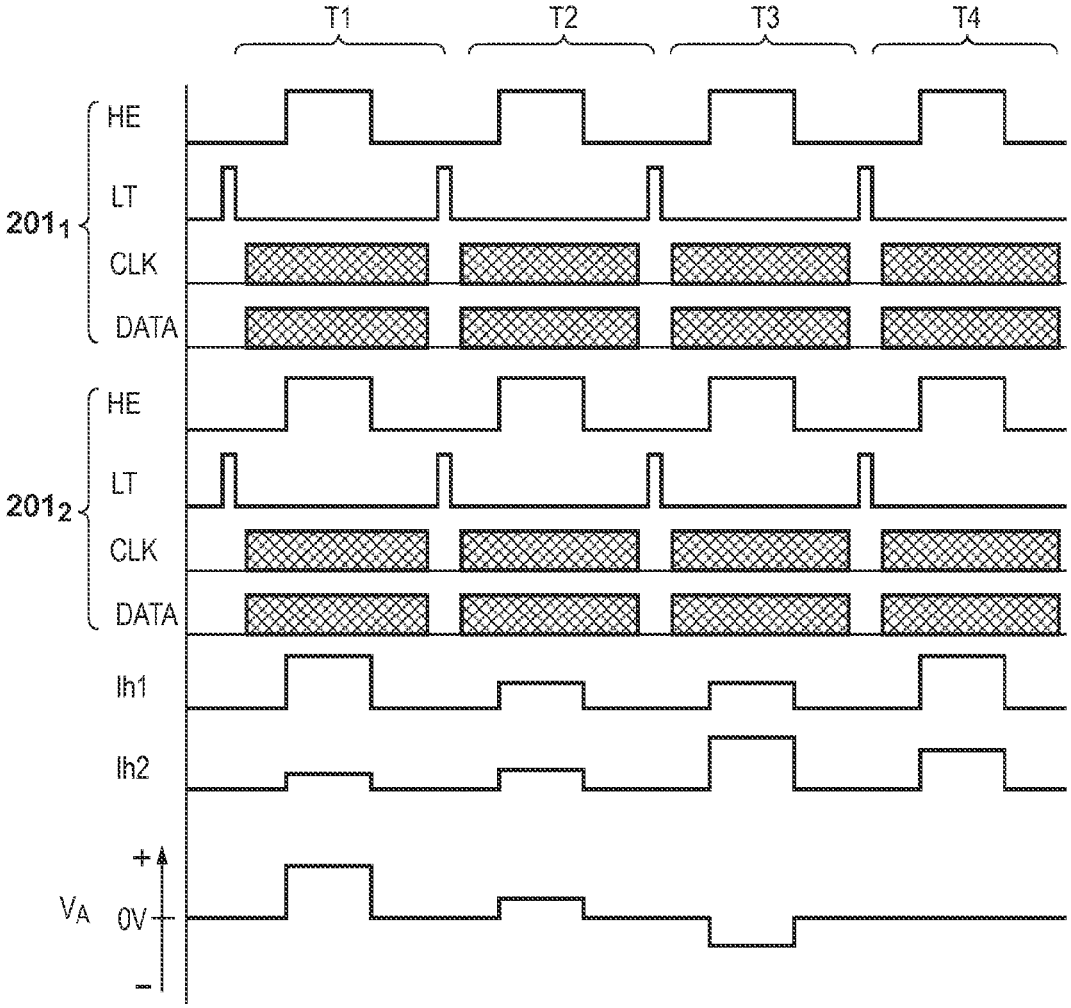
FIG. 5 is a timing chart for explaining the operation.

FIG. 5 is a timing chart in the example of the arrangement in FIG. 4 (especially the currents Ih1 and Ih2, and the value of a potential $V_A$ of node A) in periods T1 to T4. Note that the respective signals (HE, LT, CLK, and DATA) in FIG. 5 input to the printing element substrate 201 via the driving signal line 105 are the same as those in FIGS. 3A and 3B, and a description thereof will be omitted. Note that the currents Ih1 and Ih2 change depending on the number of printing elements driven on the printing element substrate $201_1$ and that on the printing element substrate $201_2$, respectively. For example, in the period T1, the potential $V_A$ becomes higher than 0 [V]since Ih1>Ih2. The same also applies to the period T2. However, the potential $V_A$ becomes lower than in the period T1 because the difference between the currents Ih1 and Ih2 is smaller than that in the period T1. On the other hand, in the period T3, the potential $V_A$ becomes lower than 0 [V]since Ih1<Ih2. In the period T4, the potential $V_A$ becomes 0 [V]since Ih1=Ih2.

In this embodiment, the first wiring electrically connects the terminal Lp of the printing element substrate $201_1$ and the terminal Hp of the printing element substrate $201_2$ with each other. The third wiring electrically connects the terminal of the voltage source $409_1$ on the low-potential side and the terminal of the voltage source $409_2$ on a high-potential side with each other. One end of the second wiring is connected to the first wiring, and the other end is connected to the third wiring. Note that the second wiring is a power supply wiring to which the power supply voltage is supplied. As described above, in this embodiment, the common power supply wiring is used between the printing element substrate $201_1$ and the printing element substrate $201_2$. According to this arrangement, the potential fluctuation of node A between the terminal Lp of the printing element substrate $201_1$ and the terminal Hp of the printing element substrate $201_2$ becomes smaller as compared with an arrangement where the power supply node and the ground node are provided respectively in each of the printing element substrates $201_1$ and $201_2$ to supply the power supply voltage. This is because the absolute value of the amount of the current flowing through the resistance Rb becomes low.

More specifically, although the current discharged from the printing element substrate $201_1$ and the current supplied to the printing element substrate $201_2$ flow through the power supply wiring corresponding to the resistance Rb, these currents are opposite in direction, and thus the net amount of the current flowing through the power supply wiring becomes small. Therefore, the voltage drop in the power supply wiring is reduced, resulting in suppressing the voltage fluctuation between the terminals Hp and Lp in each of the printing element substrates $201_1$ and $201_2$.

In this embodiment, the above-described arrangement makes it possible to reduce the number of power supply wirings while suppressing the voltage drop in the power supply wiring. When the number of power supply wirings is reduced by a so-called parallel connection of electrically connecting the terminal Hp of the printing element substrate $201_1$ and the terminal Hp of the printing element substrate $201_2$ with each other, the voltage drop cannot be suppressed. On the other hand, in this embodiment, it is possible to reduce the number of power supply wirings while suppressing the voltage drop by a so-called series connection of electrically connecting the terminal Lp of the printing element substrate $201_1$ and the terminal Hp of the printing element substrate $201_2$ with each other.

Also, according to this embodiment, the number of power supply wirings can further be reduced as compared with the arrangement where the power supply node and the ground node are provided respectively in each of the printing element substrates $201_1$ and $201_2$ to supply the power supply voltage. For example, four power supply wirings need to be prepared in total in the arrangement where the power supply node and the ground node are provided respectively in each of the printing element substrates $201_1$ and $201_2$ to supply the power supply voltage. In this embodiment, however, only three power supply wirings need to be prepared.

Furthermore, according to this embodiment, since the voltage drop is suppressed, it is possible to obtain a high printing speed and also to reduce the pulse width of HE.

Second Embodiment

Figure 6A:
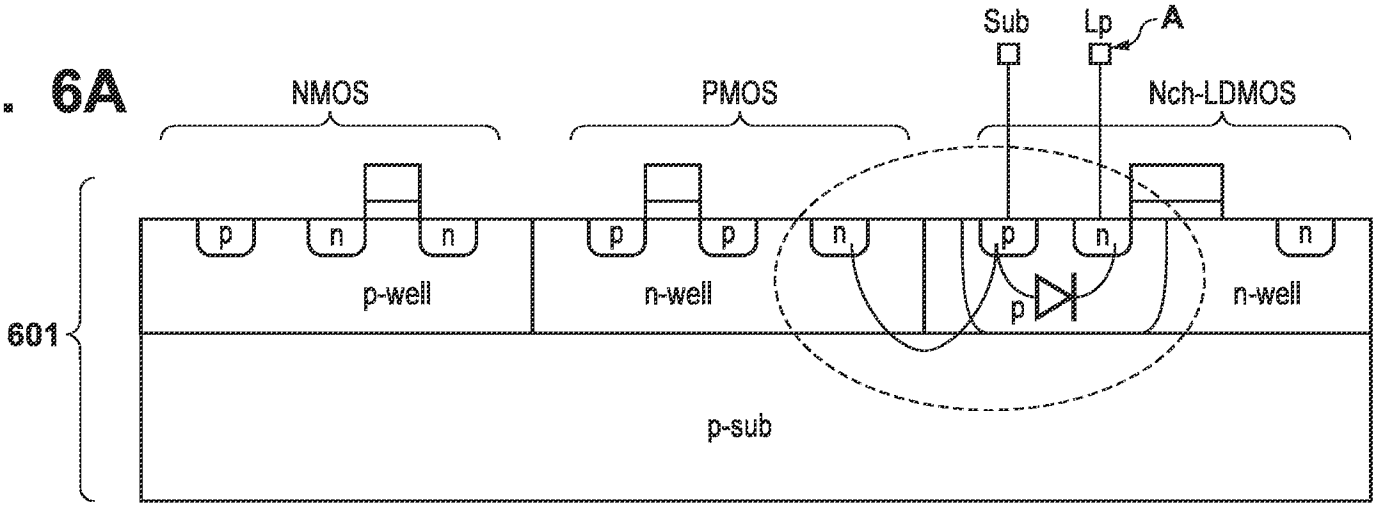
FIGS. 6A and 6B are views for explaining examples of the sectional structures of printing element substrates.
Figure 6B:
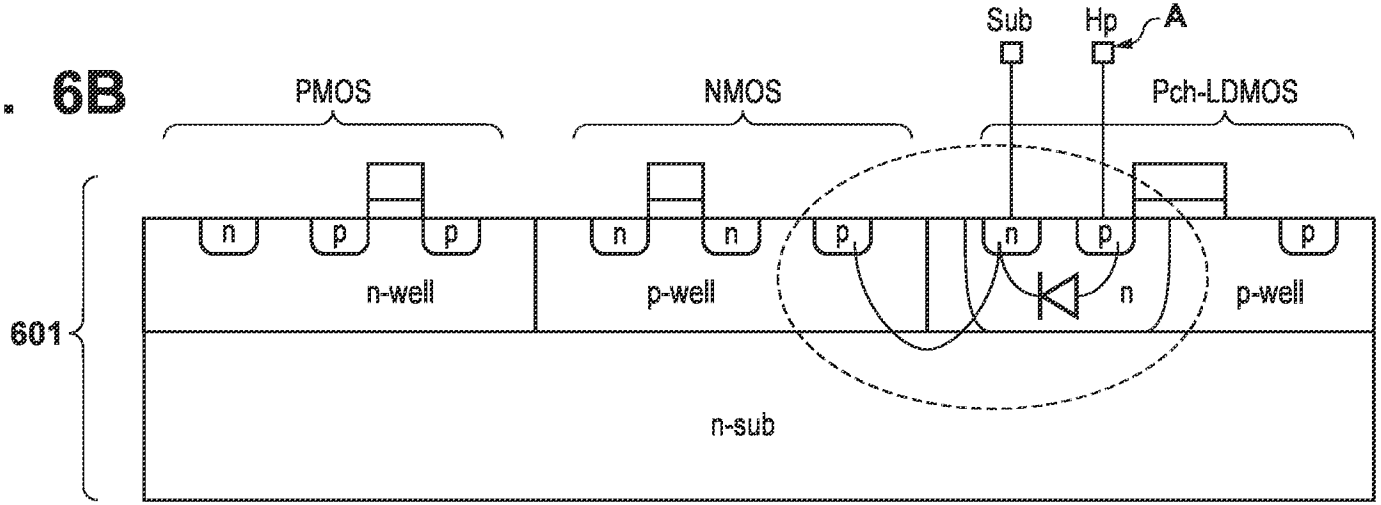

The second embodiment will be described with reference to FIGS. 6A to 10. FIGS. 6A and 6B are schematic views for explaining examples of the sectional structures of the printing element substrates $201_1$ and $201_2$ described in the first embodiment. FIG. 6A shows a structure 601 when, for example, p-wells and n-wells are formed on a p-type substrate, and a MOS transistor is formed in each of these wells. FIG. 6A shows an NMOS transistor, a PMOS transistor, and an n-channel LDMOS (Laterally Diffused MOS) transistor in order from left to right. A region including the n-well of the PMOS transistor, the p-well of the LDMOS transistor, and the n-type source region of the LDMOS transistor is indicated by the broken line. This region forms an n-p-n junction. That is, an npn parasitic bipolar transistor exists in the structure 601.

Similarly, FIG. 6B shows a structure 602 when p-wells and n-wells are formed on an n-type substrate, and a MOS transistor is formed in each of these wells. The structure 602 is the same as the structure 601 except that its conductivity types are reversed, and the description thereof will be omitted. A pnp parasitic bipolar transistor exists in the structure 602, as indicated by the broken line in FIG. 6B.

These parasitic bipolar transistors may cause latch-up by a base-potential fluctuation. In the structure 601, for example, the n-well of the PMOS transistor, the p-well of the LDMOS transistor, and the n-type source region of the LDMOS transistor can be associated with the collector, the base, and the emitter of the npn parasitic bipolar transistor, respectively. When the potential of node A fluctuates as described with reference to FIG. 5, the potential of the base (that is, the p-well of the LDMOS transistor) may fluctuate, thereby setting the above-described parasitic bipolar transistor in an operating state. For the same reason, the parasitic bipolar transistor may be set in an operating state in the structure 602.

Note that the npn (pnp) parasitic bipolar transistor between the P(N)MOS transistor and the n (p)-channel LDMOS transistor has been exemplified here. However, other parasitic bipolar transistors may be used.

Figure 7:
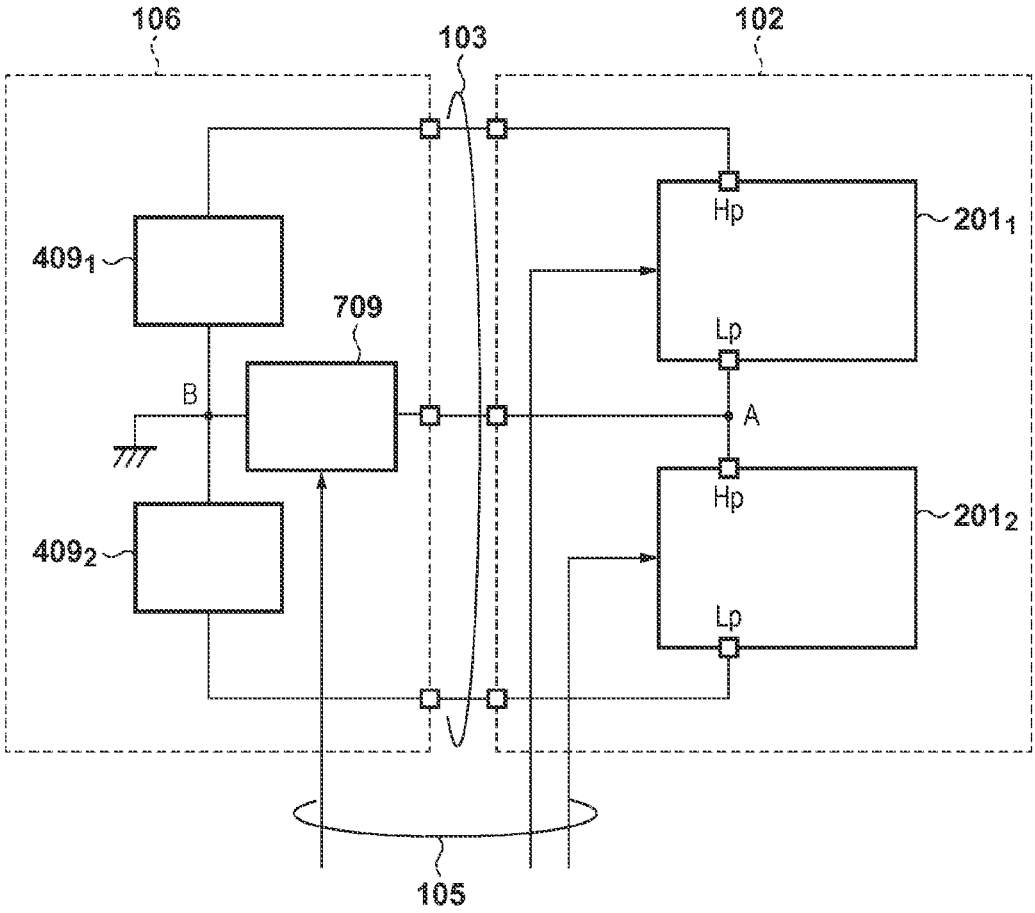
FIG. 7 is a view showing another example of an arrangement for supplying a power supply voltage to a printhead.
Figure 8A:
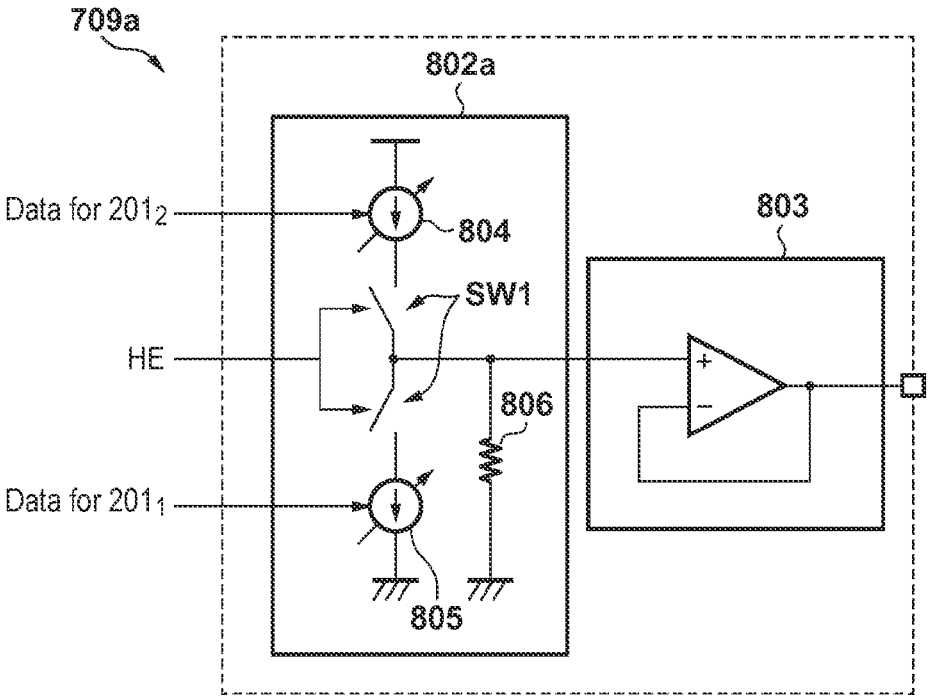
FIGS. 8A and 8B are views for explaining examples of the arrangements of a unit 709.
Figure 8B:
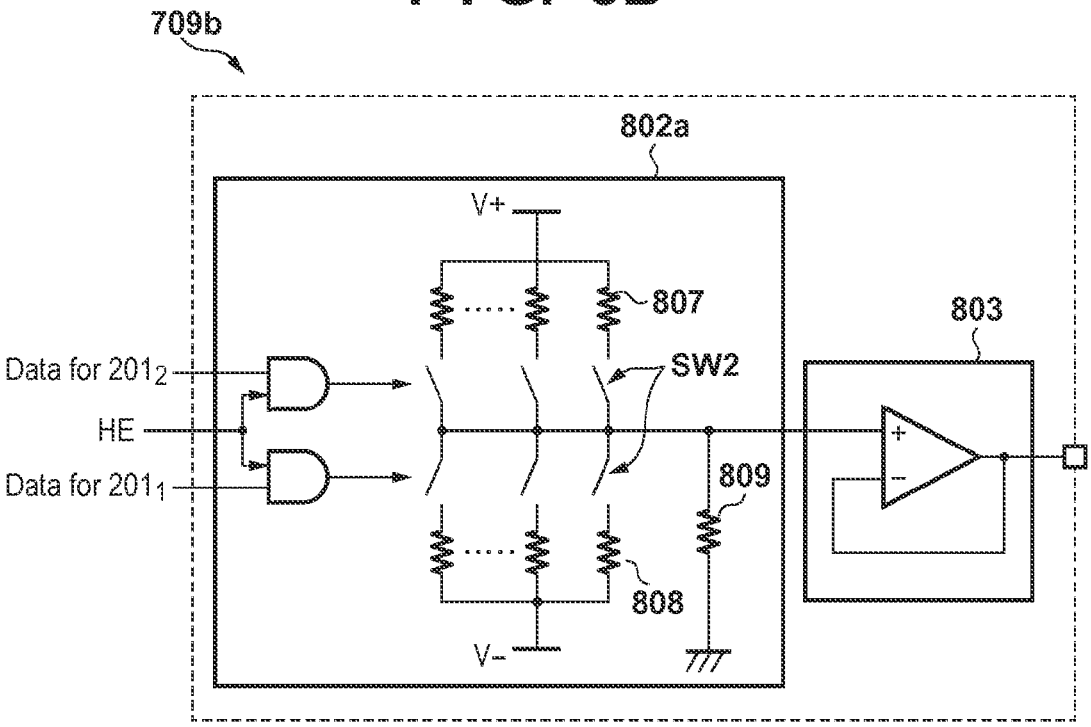

In this embodiment, as illustrated in FIG. 7, a voltage supply unit 106 further includes a unit 709 arranged between nodes A and B in the arrangement illustrated in FIG. 4. The unit 709 is an adjusting circuit which adjusts a voltage and configured to suppress the potential fluctuation of node A. FIGS. 8A and 8B show examples of circuit arrangements of the unit 709.

FIG. 8A shows the first example of the arrangement of the unit 709 which will be referred to as a "unit 709*a*" hereinafter. The unit 709*a* includes a voltage generation unit 802*a* and an output unit 803. The voltage generation unit 802*a* includes current sources 804 and 805, a switch unit SW1, and a resistance element 806. The current having an amount corresponding to the number of printing elements driven on a printing element substrate $201_2$ flows through the current source 804. The current having an amount corresponding to the number of printing elements driven on a printing element substrate $201_1$ flows through the current source 805. The switch unit SW1 changes to a conductive state in response to above-described HE. This causes the current having an amount corresponding to the difference between the current amount of the current source 804 and that of the current source 805 to flow through the resistance element 806. As a result, a potential difference may occur in the resistance element 806. The output unit 803 outputs a potential on one terminal of the resistance element 806 to node A.

Therefore, the output from the unit 709*a* becomes, for example, higher than 0 [V] when the current amount of the current source 804 is larger than that of the current source 805 on one hand, and becomes lower than 0 [V] when the current amount of the current source 804 is smaller than that of the current source 805 on the other hand. Note that the potential of node A becomes 0 [V] when the current amounts of the current source 804 and the current source 805 are equal to each other.

FIG. 8B shows the second example of the arrangement of the unit 709 which will be referred to as a "unit 709*b*" hereinafter. The unit 709*b* includes a voltage generation unit 802*b* and the output unit 803. The voltage generation unit 802*b* includes a plurality of resistance elements 807 and 808 arranged in parallel to each other, a switch unit SW2 for energizing them, a resistance element 809, and AND circuits.

The AND circuit sets, in response to HE, the switch unit SW2 in a conductive state to energize the resistance elements 807 having the number corresponding to the number of printing elements driven on the printing element substrate $\mathbf{201}_2$. The AND circuit also sets, in response to HE, the switch unit SW2 in the conductive state to energize the resistance elements 808 having the number corresponding to the number of printing elements driven on the printing element substrate $\mathbf{201}_1$. This causes the current having an amount corresponding to the difference between the number of printing elements driven on the printing element substrate $\mathbf{201}_1$ and that on the printing element substrate $\mathbf{201}_2$ to flow through the resistance element 809. As a result, a potential difference may occur in the resistance element 809. The output unit 803 outputs a potential on one terminal of the resistance element 809 to node A. Therefore, the unit 709*b* operates similarly to the unit 709*a*.

That is, both of the units 709*a* and 709*b* control the potential of node A based on the magnitude relationship between the number of printing elements driven on the printing element substrate $\mathbf{201}_1$ and that on the printing element substrate $\mathbf{201}_2$.

Figure 9:
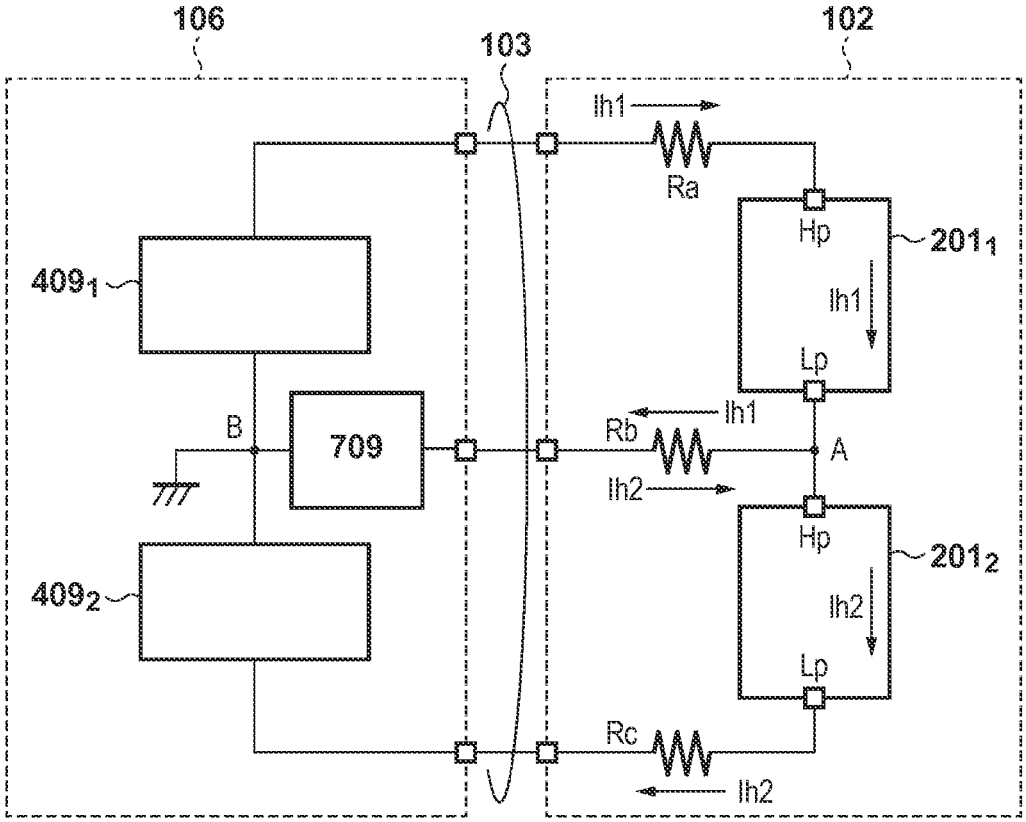
FIG. 9 is a view for explaining still another example of an arrangement for supplying the power supply voltage to the printhead.

FIG. 9 is a view for explaining the voltage drop of a power supply voltage in a printing apparatus PA illustrated in FIG. 7. FIG. 9 is different from FIG. 4 (the first embodiment) in that the voltage supply unit 106 includes the unit 709 between nodes A and B. According to this arrangement, the unit 709 suppresses the potential fluctuation of node A. More specifically, the unit 709 outputs a voltage corresponding to the potential of node B, thereby suppressing the potential fluctuation.

Figure 10:
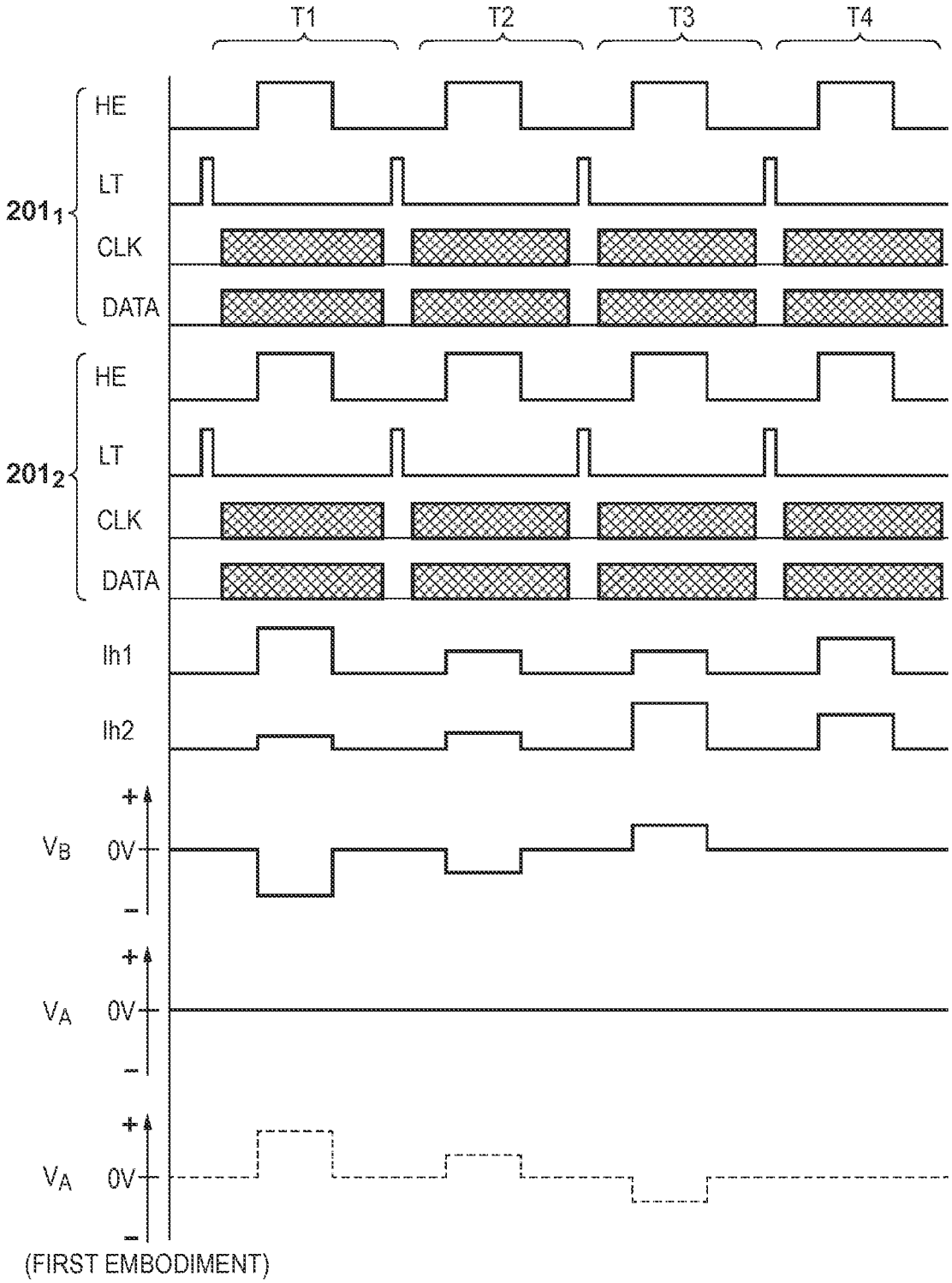
FIG. 10 is a timing chart for explaining the operation.

As in FIG. 5 (the first embodiment), FIG. 10 is a timing chart in the example of the arrangement in FIG. 9 (especially currents Ih1 and Ih2, and the values of potentials $V_A$ and $V_B$ of nodes A and B) in periods T1 to T4. FIG. 10 also shows the potential $V_A$ in the first embodiment for comparison. According to this embodiment, the unit 709 outputs a voltage corresponding to the potential $V_B$ of node B to node A, as described with reference to FIGS. 8A and 8B. Therefore, the fluctuation of the potential $V_A$ is further suppressed as compared with the first embodiment, and the potential $V_A$=0 [V] is obtained over the periods T1 to T4 in this embodiment.

In this embodiment, it is therefore possible to further suppress the potential fluctuation of the potential $V_A$ as compared with the first embodiment and prevent the above-described latch-up.

Third Embodiment

Figure 11:
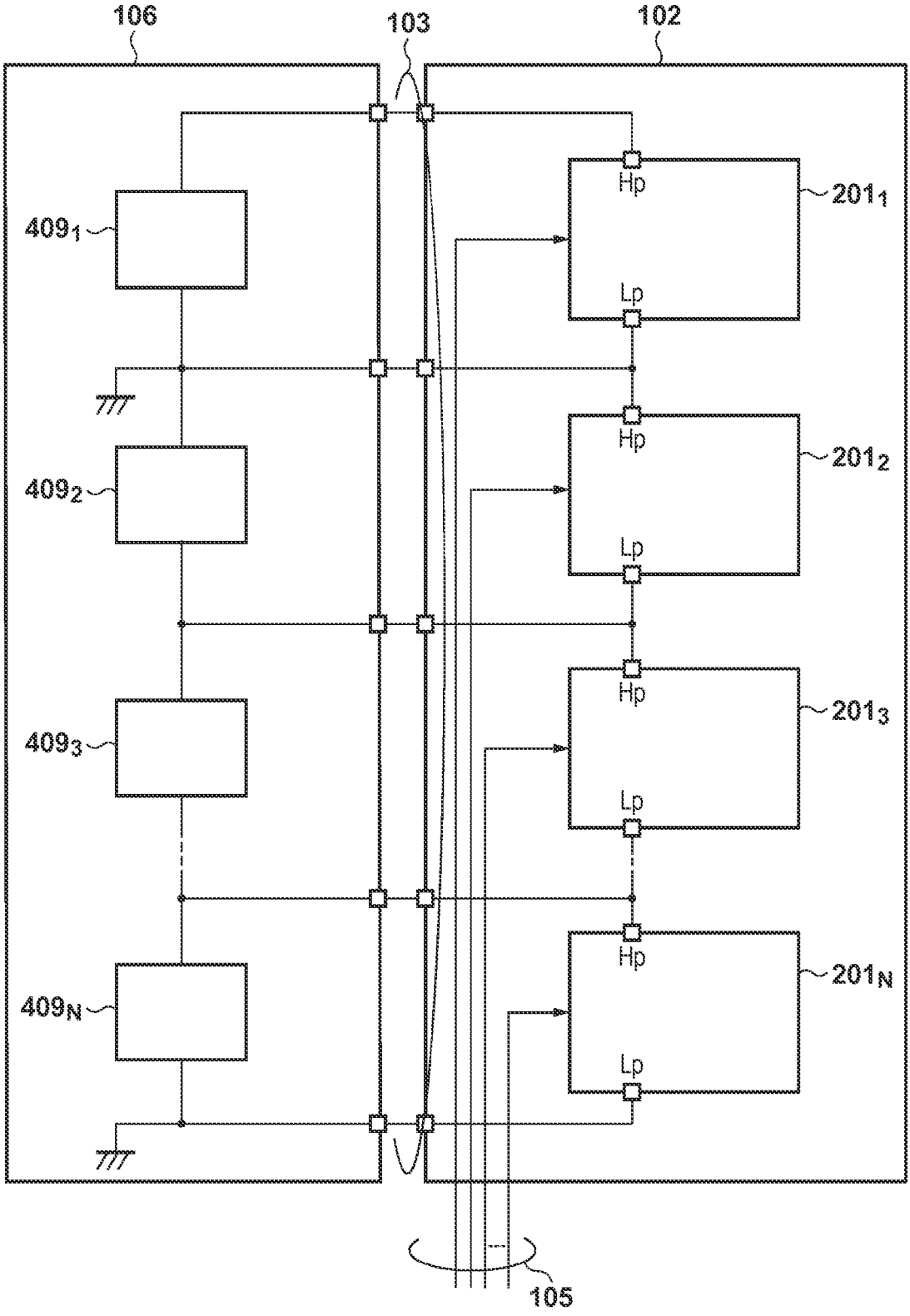
FIG. 11 is a view showing another example of an arrangement for supplying a power supply voltage to a printhead.

The third embodiment will be described with reference to FIGS. 11 and 12. In the first embodiment, two printing element substrates $\mathbf{201}_1$ and $\mathbf{201}_2$, and two voltage sources $\mathbf{409}_1$ and $\mathbf{409}_2$ have been exemplified. However, the number is not limited to two, and may be three or more. FIG. 11 mainly shows, out of an example of the arrangement of a printing apparatus PA according to this embodiment, the portions of a voltage supply unit 106 and a printhead 102. In this embodiment, N printing element substrates $\mathbf{201}_1$ to $\mathbf{201}_N$ and N voltage sources $\mathbf{409}_1$ to $\mathbf{409}_N$ are used.

N is an integer equal to or larger than two. Letting k be an integer of one (inclusive) to N−1 (inclusive), a terminal Lp of a kth printing element substrate $\mathbf{201}_k$ is connected to a terminal Hp of a (k+1)th printing element substrate $\mathbf{201}_{k+1}$, and N printing element substrates are connected in series. One power supply wiring is connected to the terminal Lp of the kth printing element substrate $\mathbf{201}_k$ and the terminal Hp of the (k+1)th printing element substrate $\mathbf{201}_{k+1}$.

Note that the terminal Lp of the Nth printing element substrate $\mathbf{201}_N$ (the negative terminal of the Nth voltage source $\mathbf{409}_N$) is grounded in this embodiment. In this arrangement, voltages higher than 0 [V] are supplied to the terminals Hp and Lp of the first to a (N−1)th printing element substrates $\mathbf{201}_1$ to $\mathbf{201}_{N-1}$, and the terminal Hp of the Nth printing element substrate $\mathbf{201}_N$. These printing element substrates $\mathbf{201}_1$ to $\mathbf{201}_N$ need to be electrically insulated from each other. Each element such as a MOS transistor may be formed by using, for example, a triple well structure or an SOI substrate.

Figure 12:
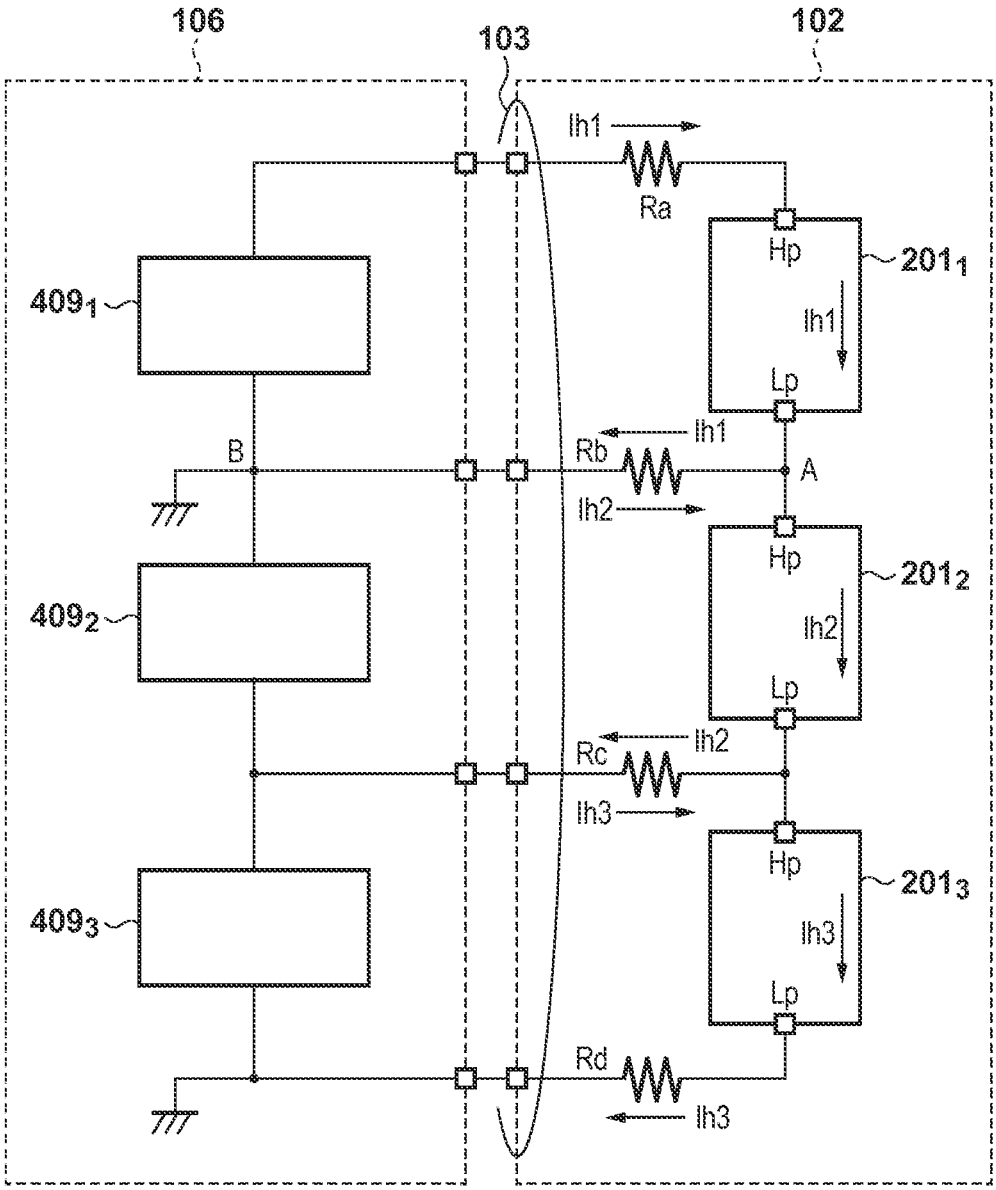
FIG. 12 is a view for explaining still another example of an arrangement for supplying the power supply voltage to the printhead.

When, for example, N=3, letting a current flowing through the printing element substrate $\mathbf{201}_3$ be a current Ih3, a voltage drop in a resistance Rc is represented by Rc×(Ih2−Ih3), whereas the voltage drop in the first embodiment is represented by Rc×Ih2, as illustrated in FIG. 12. Therefore, in the arrangement of FIG. 12, the potential fluctuation in the resistance Rc decreases. Note that a voltage drop in a resistance Rd can be represented by Rd×Ih3.

As described above, according to this embodiment, the same effect as in the first embodiment can be obtained in an arrangement where three or more printing element substrates 201 are used. In particular, this embodiment is also advantageous in reducing the number of power supply wirings. For example, N×2 power supply wirings need to be prepared in an arrangement where a power supply node and a ground node are provided respectively in each of the printing element substrates $\mathbf{201}_1$ and $\mathbf{201}_N$ to provide a power supply voltage. In this embodiment, however, only N+1 power supply wirings need to be prepared.

(Others)

The three embodiments have been described above. However, the present invention is not limited to these modes. The present invention may be changed in accordance with specifications or the like and combine the arrangements of the respective embodiments.

A printing apparatus PA scans a printhead 102 on a printing medium while conveying the printing medium and prints on the printing medium. The plurality of printing element substrates 201 described above are arranged on a side where printing is performed by the printhead 102. A plurality of nozzles (orifices) are provided in the printhead 102 to correspond to a plurality of printing elements on each printing element substrate 201. In response to driving of a certain printing element, a printing agent (ink) is discharged from the corresponding nozzle to the printing medium.

For a full-line type printhead capable of printing, at once, an entire region in the widthwise direction of a printing medium (a direction intersecting the conveyance direction of the printing medium), the plurality of printing element substrates 201 can be arranged, for example, in a staggered arrangement in the arrangement direction of the printing elements.

Note that "printing" can include, in addition to printing of forming significant information such as characters and graphics, printing in a broad sense regardless of whether information is significant or insignificant. For example, "printing" need not be visualized to be visually perceivable by humans, and can also include printing of forming images, figures, patterns, structures, and the like on a printing medium, or printing of processing the medium.

In addition, "printing agent" can include a consumable used for printing in addition to "ink" used in each embodiment described above. For example, "printing agent" can include a liquid which is used to process a printing medium or to process ink (for example, to solidify or insolubilize a colorant in ink applied onto a printing medium) as well as a liquid which is applied onto a printing medium to form images, figures, patterns, and the like. Furthermore, it is possible to adopt, for example, an arrangement configured to perform printing by applying ink onto an intermediate transfer medium and then transferring the ink onto a printing medium, instead of an arrangement configured to directly apply ink onto a printing medium. It is also possible to use an arrangement configured to perform monochrome printing using one type of ink (for example, black ink), instead of an arrangement configured to perform color printing using a plurality of types of inks.

In addition, "printing medium" can include any media capable of receiving a printing agent, such as cloth, plastic films, metal plates, glass, ceramics, resin, wood, and leather, as well as paper used in general printing apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-039288, filed Feb. 28, 2014, which is hereby incorporated by reference herein in its entirety.

What is claimed is:

1. A printing apparatus comprising:

first and second printing element substrates, each including a printing element;

first and second voltage sources, which correspond to the first and second printing element substrates, respectively, each configured to supply a power supply voltage to a corresponding one of the first and second printing element substrates, wherein each of the first and second printing element substrates includes a first terminal and a second terminal for receiving the power supply voltage from a corresponding one of the first and second voltage sources, each first terminal serving as a terminal on a high-potential side and each second terminal serving as a terminal on a low-potential side;

a first wiring which connects the second terminal of the first printing element substrate and the first terminal of the second printing element substrate with each other;

a second wiring having one end connected to the first wiring; and a third wiring configured such that the first and second voltage sources are connected in series, the third wiring being grounded and connected to the other end of the second wiring.

2. The apparatus according to claim 1, further comprising an adjusting circuit configured to suppress a fluctuation of a potential of a first node, the first node being a node on the first wiring, wherein the adjusting circuit is arranged between the first node and a second node, the second node being a node on the third wiring.

3. The apparatus according to claim 2, wherein the first and second substrates each include plural printing elements, and the adjusting circuit outputs, to the first node, a voltage corresponding to a difference between the number of printing elements driven on the first printing element substrate and that on the second printing element substrate.

4. The apparatus according to claim 3, wherein the adjusting circuit includes a first current source and a second current source arranged in series, the first current source supplies a current having an amount corresponding to the number of printing elements driven on the first printing element substrate, the second current source supplies a current having an amount corresponding to the number of printing elements driven on the second printing element substrate, and the adjusting circuit outputs a voltage corresponding to a difference between the current amount of the first current source and that of the second current source.

5. The apparatus according to claim 3, wherein the adjusting circuit includes a first path and a second path arranged in series, each of the first path and the second path includes a plurality of resistance elements arranged in parallel to each other and a switch unit, in the first path, the switch unit drives the number of resistance elements corresponding to the number of printing elements driven on the first printing element substrate, in the second path, the switch unit drives the number of resistance elements corresponding to the number of printing elements driven on the second printing element substrate, and the adjusting circuit outputs a voltage corresponding to a difference between the number of resistance elements driven in the first path and that in the second path.

6. The apparatus according to claim 1, wherein a printhead including the first and second printing element substrates is of a full-line type.

7. The apparatus according to claim 6, wherein the first and second printing element substrates are arranged in a staggered arrangement.

8. The apparatus according to claim 1, further comprising a printing agent supply unit configured to supply a printing agent to each of the first and second printing element substrates.

9. The apparatus according to claim 1, wherein the second wiring includes a resistance component larger than that of each of the first wiring and the third wiring.

10. A printhead comprising:

first and second printing element substrates, each including a printing element;

first and second voltage sources, which correspond to the first and second printing element substrates, respectively, each configured to supply a power supply voltage to a corresponding one of the first and second printing element substrates, wherein each of the first and second printing element substrates includes a first terminal and a second terminal for receiving the power supply voltage from a corresponding one of the first and second voltage sources, each first terminal serving as a terminal on a high-potential side and each second terminal serving as a terminal on a low-potential side;

a first wiring which connects the second terminal of the first printing element substrate and the first terminal of the second printing element substrate with each other;

a second wiring having one end connected to the first wiring; and a third wiring configured such that the first and second voltage sources are connected in series, the third wiring being grounded and connected to the other end of the second wiring.

* * * * *